US010981184B2

(12) United States Patent
Cho et al.

(10) Patent No.: US 10,981,184 B2
(45) Date of Patent: Apr. 20, 2021

(54) COATING APPARATUS AND COATING METHOD

(71) Applicant: SEMES CO., LTD., Chungcheongnam-do (KR)

(72) Inventors: Soon Cheon Cho, Gyeonggi-do (KR); Bongkyu Shin, Chungcheongnam-do (KR); Hyun Joong Kim, Gyeonggi-do (KR)

(73) Assignee: SEMES CO., LTD., Chungcheongnam-do (KR)

( * ) Notice: Subject to any disclaimer, the term of this patent is extended or adjusted under 35 U.S.C. 154(b) by 0 days.

(21) Appl. No.: 15/935,111

(22) Filed: Mar. 26, 2018

(65) Prior Publication Data

US 2018/0272366 A1 Sep. 27, 2018

(30) Foreign Application Priority Data

Mar. 27, 2017 (KR) ..... 10-2017-0038701

(51) Int. Cl.

| | |
|---|---|
| ***B05B 5/025*** | (2006.01) |
| ***B05C 5/02*** | (2006.01) |
| ***B05B 17/04*** | (2006.01) |
| ***B05B 5/08*** | (2006.01) |
| ***B05B 7/22*** | (2006.01) |
| ***B05B 5/00*** | (2006.01) |
| ***B05D 1/04*** | (2006.01) |
| *B05D 3/00* | (2006.01) |
| *B05D 3/14* | (2006.01) |

(52) U.S. Cl.

CPC ..... *B05B 5/025* (2013.01); *B05B 5/081* (2013.01); *B05B 5/087* (2013.01); *B05B 17/04* (2013.01); *B05C 5/0291* (2013.01); *B05D 1/04* (2013.01); *B05B 5/001* (2013.01); *B05B 5/082* (2013.01); *B05B 7/22* (2013.01); *B05D 3/141* (2013.01); *B05D 3/20* (2013.01)

(58) Field of Classification Search

CPC ..... B05B 5/025; B05B 5/082; B05B 5/087; B05B 17/04; B05C 5/0291

See application file for complete search history.

(56) References Cited

U.S. PATENT DOCUMENTS

2004/0177807 A1* 9/2004 Pui ..... B01J 2/006 118/303
2009/0093105 A1* 4/2009 Kobayashi ..... B05B 5/087 438/478

(Continued)

FOREIGN PATENT DOCUMENTS

CN 101069275 A 11/2007
CN 101678373 A 3/2010

(Continued)

*Primary Examiner* — Dah-Wei D. Yuan
*Assistant Examiner* — Stephen A Kitt
(74) *Attorney, Agent, or Firm* — Li & Cai Intellectual Property (USA) Office

(57) ABSTRACT

Disclosed are a coating apparatus and a coating method. The coating apparatus includes a chamber, a support located in an interior space of the chamber and configured to support a substrate which is to be coated, an ejection nozzle configured to eject a coating material toward the support, and an electric field forming unit configured to form an electric field in a movement path of the coating material to provide kinetic energy for the coating material.

12 Claims, 4 Drawing Sheets

(56) References Cited

U.S. PATENT DOCUMENTS

| | | | | |
|---|---|---|---|---|
| 2010/0006027 | A1* | 1/2010 | Yang | B05B 5/082 118/671 |
| 2015/0251214 | A1* | 9/2015 | Leschkies | D01D 5/0092 427/469 |
| 2016/0172174 | A1 | 6/2016 | Takahashi | |

FOREIGN PATENT DOCUMENTS

| | | | |
|---|---|---|---|
| CN | 101952939 | A | 1/2011 |
| CN | 103906703 | A | 7/2014 |
| CN | 104417058 | A | 3/2015 |
| DE | 102013113169 | A1 | 5/2015 |
| JP | 2007-294220 | A | 11/2007 |
| JP | 4689843 | B | 2/2011 |
| JP | 2014-525984 | A | 10/2014 |
| WO | 2006043656 | A1 | 4/2006 |

* cited by examiner

COATING APPARATUS AND COATING METHOD

CROSS-REFERENCE TO RELATED APPLICATIONS

A claim for priority under 35 U.S.C. § 119 is made to Korean Patent Application No. 10-2017-0038701 filed on Mar. 27, 2017, in the Korean Intellectual Property Office, the entire contents of which are hereby incorporated by reference.

BACKGROUND

Embodiments of the inventive concept described herein relate to a coating apparatus and a coating method.

Substrates may be coated for improvement and change of physical and chemical characteristics. The coating methods include deposition, such as PVD or CVD, spraying, and aerosol deposition.

In the aerosol deposition, a coating material in an aerosol state is ejected toward a substrate at a preset pressure. The coating material has kinetic energy due to the ejection speed. The kinetic energy of the coating material is converted to thermal energy during collision with the substrate. The thermal energy fuses the coating material and the coating material is coated on the substrate. In the aerosol deposition, the particle sizes of the usable coating material are restricted due to the kinetic energy of the coating material and the degree of heat obtained by converting the kinetic energy to thermal energy.

SUMMARY

Embodiments of the inventive concept provide a coating apparatus and a coating method, by which a substrate may be efficiently coated.

In accordance with an aspect of the inventive concept, there is provided a coating apparatus including a chamber, a support located in an interior space of the chamber and configured to support a substrate which is to be coated, an ejection nozzle configured to eject a coating material toward the support, and an electric field forming unit configured to form an electric field in or along a movement path of the coating material to provide kinetic energy for the coating material. The electric field lines of the electric field continuously travel in a direction of the movement path of the coating material.

The electric field forming unit may include an electrode member located between the support and the ejection nozzle, and a power source configured to apply a voltage between the substrate located in the support and the electrode member.

The electrode member may have holes, through which the coating material passes.

The electrode member may have a mesh shape.

The substrate may be connected to the power source and the electrode member is grounded.

The power source may be a DC power source.

The support may be located on an upper wall of the chamber and the electrode member may be located at a lower portion of the interior space of the chamber.

The chamber may have an exhaust hole for exhausting the interior space thereof.

The electric field forming unit may further include a connecting line that connects the substrate to the power source to apply a voltage if the substrate is located in the support.

The electric field forming unit may further include an auxiliary electrode member located inside the support and electrically connected to the power source.

The coating apparatus may further include a magnetic field forming unit configured to form a magnetic field in the movement path of the coating material.

The magnetic field forming unit may be located on a side of the movement path of the coating material.

The magnetic field forming unit may include a first magnet and a second magnet located on opposite sides with respect to the movement path of the coating material.

The ejection nozzle may eject the coating material in an aerosol state.

In accordance with another aspect of the inventive concept, there is provided a method for coating a substrate, the method including ejecting a coating material with an ejection nozzle, ionizing the coating material, and guiding the ionized coating material toward the substrate through an electric field to force the coating material to collide with the substrate.

The coating material may be ionized through ions provided by the electrode member while passing through an electrode member located in front of the ejection nozzle with respect to an ejection direction of the coating material.

The electrode member may include holes, the coating material may move toward the substrate across the electrode member through the holes, and the electric field be formed between the substrate and the electrode member.

A magnetic field may be formed in a movement path of the coating material when the coating material is guided toward the substrate.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Hereinafter, exemplary embodiments of the inventive concept will be described in more detail with reference to the accompanying drawings. The embodiments of the inventive concept may be modified in various forms, and the scope of the inventive concept should not be construed to be limited to the following embodiments. The embodiments of the inventive concept are provided to describe the inventive concept for those skilled in the art more completely. Accordingly, the shapes of the components of the drawings are exaggerated to emphasize clearer description thereof.

Figure 1:
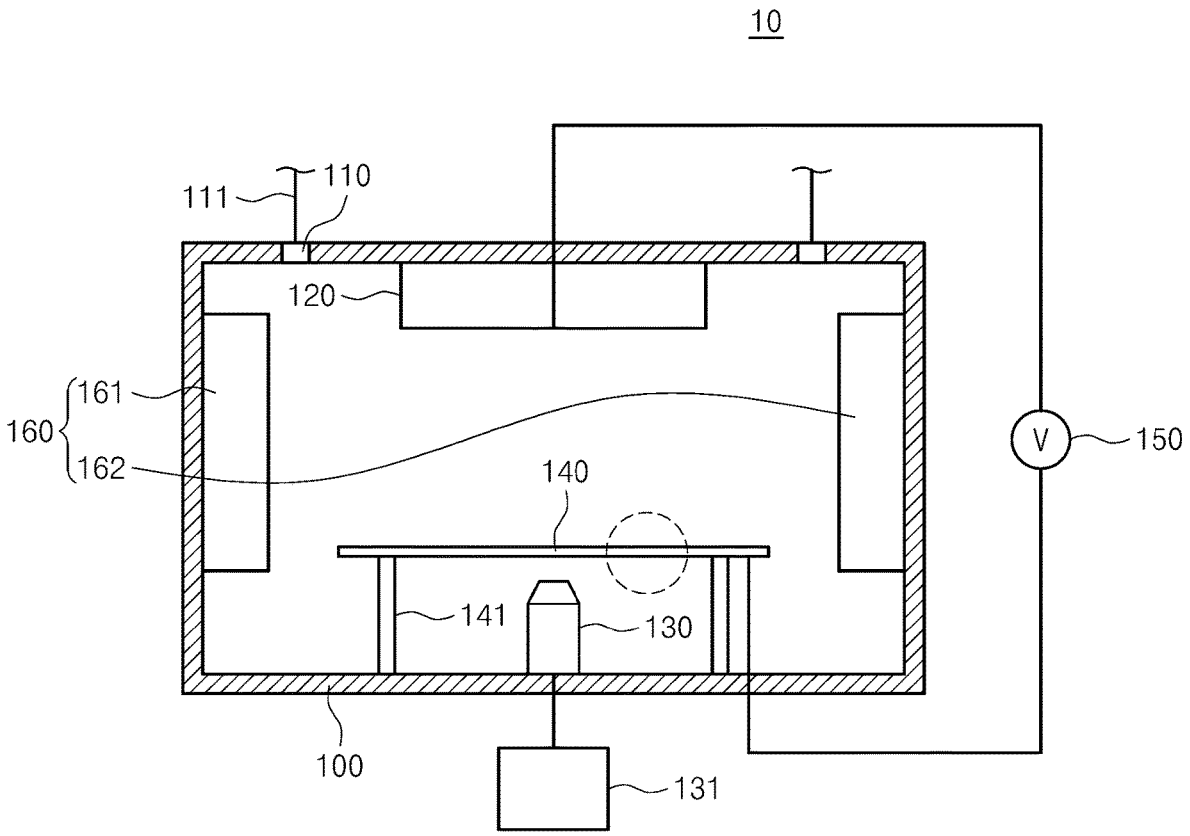
FIG. 1 is a view illustrating a coating apparatus according to an embodiment of the inventive concept.

FIG. 1 is a view illustrating a coating apparatus according to an embodiment of the inventive concept.

Referring to FIG. 1, the coating apparatus 10 includes a chamber 100, a support 120, an ejection nozzle 130, an electric field forming unit 140 and 150, and a magnetic field forming unit 160.

The chamber 100 provides a space having a preset volume and in which coating is performed. An exhaust hole 100 is formed on one side of the chamber 100. The exhaust hole 110 is connected to an exhaust line 111, and exhausts the interior space through a negative pressure applied to the exhaust line 111. The exhaust hole 110 may be formed on a surface of the chamber 100 on which the support 120 is located.

The support 120 is located inside the chamber 100 and supports the substrate m (see FIG. 3) on which coating is to be performed. As an example, the support 120 may be located on an upper wall of the chamber 100, and the substrate m may be absorbed on the bottom surface of the support 110.

The ejection nozzle 130 ejects a coating material into the interior space. As an example, the ejection nozzle 130 may be located in the interior space of the chamber 100, an end of the ejection nozzle 130 may be located to communicate with the interior space of the chamber 100, and the coating material ejected from the ejection nozzle 130 may be supplied into the interior space of the chamber 100. The ejection nozzle 130 may eject the coating material in an aerosol state. The ejection nozzle 130 may eject the coating material at a preset pressure. The coating material may be ceramic. The particle diameters of the ejected coating material may range from several micrometers to several nanometers. The ejection nozzle 130 may be located in a direction that faces the support 120, and ejects the coating material toward the support 120. If the support 120 is located on an upper wall of the chamber 100, the ejection nozzle 130 may be located at a lower portion the chamber 100 and may eject the coating material from the lower side to the upper side.

Figure 2:
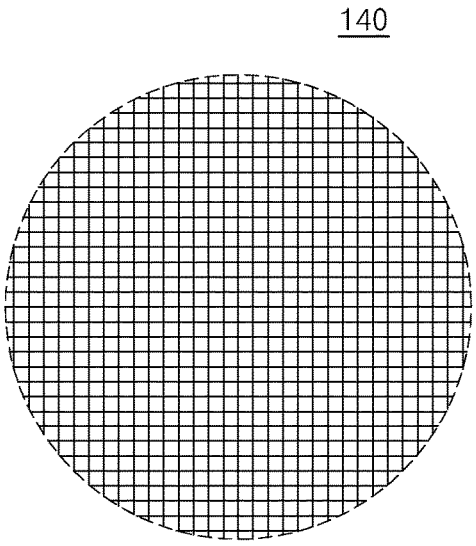
FIG. 2 is an enlarged view of an electrode member.

FIG. 2 is an enlarged view of an electrode member.

Referring to FIGS. 1 and 2, the electric field forming unit 140 and 150 forms an electric field in a movement path of the coating material, and provides kinetic energy for the coating material. The electric field forming unit 140 and 150 includes an electrode member 140 and a power source 150.

The electrode member 140 may be located between the support 120 and the ejection nozzle 130. As an example, the electrode member 140 may be spaced apart from an end of the ejection nozzle 130 by a preset distance in a movement direction of the coating material. The coating material ejected from the ejection nozzle 130 moves across the electrode member 140. The electrode member 140 includes holes that provide the movement path of the ejection nozzle 130. As an example, the electrode member 140 may be provided in a form of a mesh. The electrode member 140 is formed of a conductive material such as a metal. The electrode member 140 may be fixed to the chamber 100 by a fixing unit 141.

The power source 150 forms an electric potential between the electrode member 140 and the substrate m. In detail, the power source 150 may be electrically connected to the electrode member 140 and the substrate m. In detail, one side of the power source 150 may be connected to the electrode member 140 through an electric wire, and an opposite side of the power source 150 may be connected to an upper surface of the support 120 through an electric wire. Accordingly, if the substrate m is located in the support 120, a voltage is applied to the substrate m and the electrode member 140 by the power source 150. The power source 150 is provided as a DC power source 150 such that a positive electrode thereof may be connected to the substrate m and a negative electrode thereof may be connected to the electrode member 140. Further, one side of the power source 150 and the electrode member 140 may be connected to each other in a grounding manner.

The magnetic field forming unit 160 forms a magnetic field in the movement path of the coating material. The magnetic field forming unit 160 includes a first magnet 161 and a second magnet 162. The magnetic field forming unit 160 is located on a side of the movement path of the coating material. When the support 120 is located on an upper wall of the chamber 100 and the ejection nozzle 130 is located at a lower portion the chamber 100, the first magnet 161 and the second magnet 162 may be located on a side wall of the chamber 100. The first magnet 161 and the second magnet 162 may face each other with respect to the movement path of the coating material. Facing surfaces of the first magnet 161 and the second magnet 162 may have different polarities. The first magnet 161, the second magnet 162, or the first magnet 161 and the second magnet 162 may be magnets, the magnetic flux densities of which may be adjusted. In order that a magnetic field may be formed throughout the movement path of the coating material, the substrate m may be located between upper portions of the first magnet 161 and the second magnet 162 and the electrode member 140 may be located between lower portions of the first magnet 161 and the second magnet 162.

Figure 3:
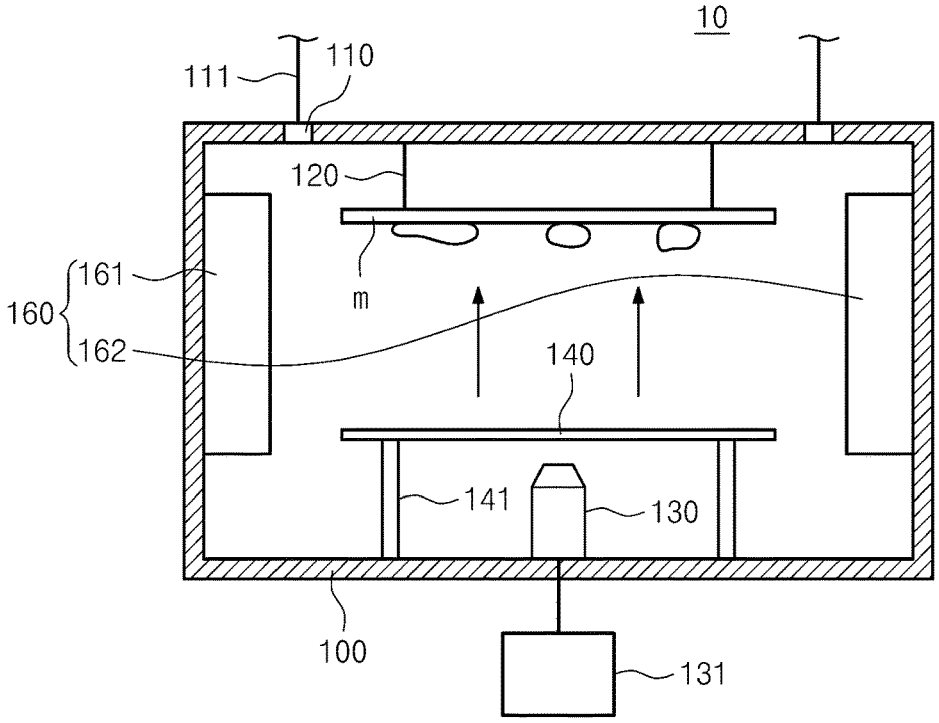
FIG. 3 is a view illustrating a state in which coating is performed.

FIG. 3 is a view illustrating a state in which coating is performed.

Referring to FIG. 3, the coating material ejected from the ejection nozzle 130 collides with the substrate m located in the support 120. The coating material ejected in an aerosol state at a preset pressure has kinetic energy, and the coating material is coated on the substrate m while the kinetic energy is converted to thermal energy while colliding with the substrate m. While the coating is performed, exhaustion is made through an exhaust hole 110. The exhaust hole 110 may be provided in a direction which faces the ejection nozzle 130 and in which the support 120 is located, and the negative pressure due to the exhaustion may additionally provide kinetic energy to the coating material.

The coating material may be charged with negative ions while passing through the electrode member 140. As an example, the coating material may be material, such as an oxide or a nitride, which easily receives electrons. Accordingly, the coating material may receive electrons from the electrode member 140 to be charged with negative ions while moving to the substrate m through the holes of the electrode member 140. Further, the charged coating material may collide with the substrate m after being moved while the kinetic energy thereof is adjusted by the electric field formed between the electrode member 140 and the substrate m. If the power source 150 is provided with a DC power source 150, the kinetic energy of the charged coating material increases due to the electric field, and the coating quality may be improved as the fusion degree increases when the coating material collides with the substrate m.

According to an embodiment of the inventive concept, because the process of coating the coating material is controlled by adjusting a movement state of the coating material through an electric field, the coating quality may be improved.

Further, according to an embodiment of the inventive concept, because the movement state of the coating material is adjusted through an electric field, the coating material having a wide range of particle sizes may be used for the coating.

Figure 4:
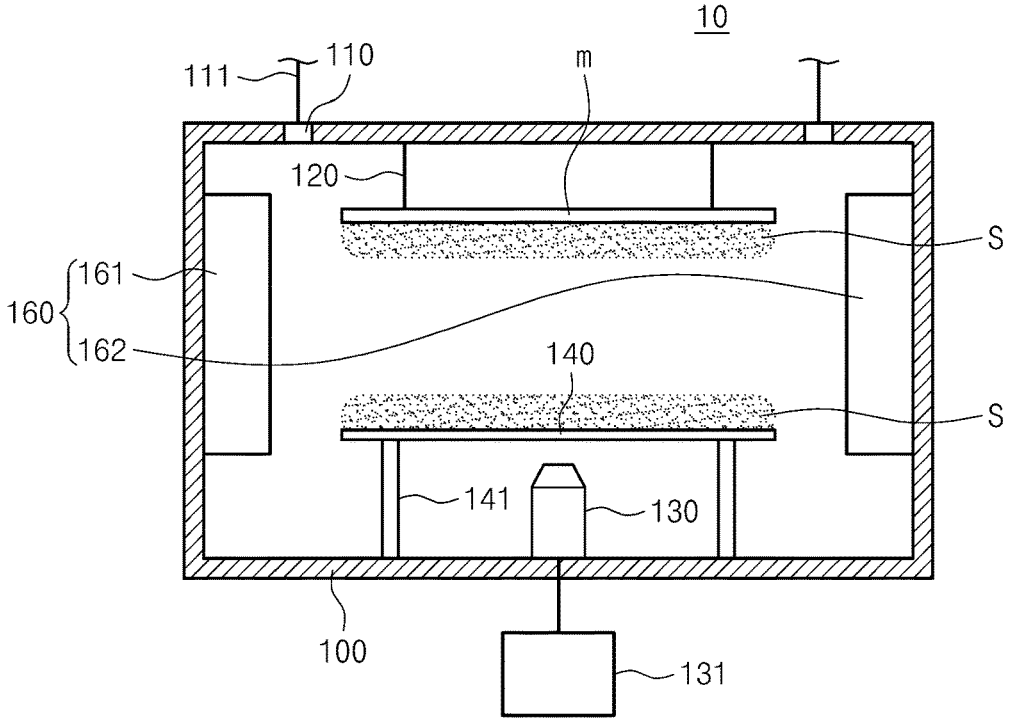
FIG. 4 is a view illustrating a sheath formed by an electric field forming unit.
Figure 5:
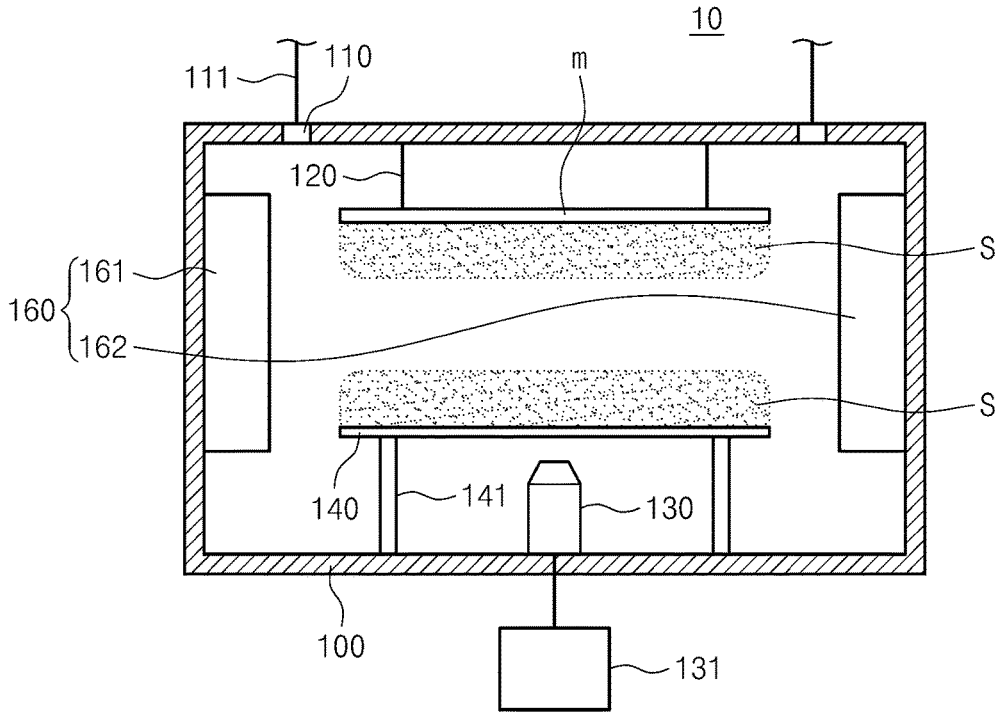
FIG. 5 is a view illustrating a state in which a state of the sheath is adjusted.

FIG. 4 is a view illustrating a sheath formed by an electric field forming unit. FIG. 5 is a view illustrating a state in which a state of the sheath is adjusted.

Referring to FIGS. 4 and 5, plasma may be excited by the electric field forming unit 140 and 150 in the interior of the chamber 100. If plasma is excited, a sheath s is formed around the electrode member 140 and the substrate m.

As the coating material is charged while passing through the electrode member 140, the mobility of the coating material increases in the sheath s. The thickness of the sheath s may be adjusted by a magnetic field provided by the magnetic field forming unit 160. Accordingly, when the coating material is ejected to the substrate m to be coated, the kinetic energy of the coating material when the coating material collides with the substrate m may be adjusted by adjusting the magnetic flux formed by the magnetic field forming unit 160 to adjust the sheath s.

According to an embodiment of the inventive concept, because the process of coating the coating material is controlled by adjusting a movement state of the coating material by adjusting the sheath s, the coating quality may be improved.

Further, according to an embodiment of the inventive concept, because the movement state of the coating material is adjusted through the sheath s, the coating material having a wide range of particle sizes may be used for the coating.

Figure 6:
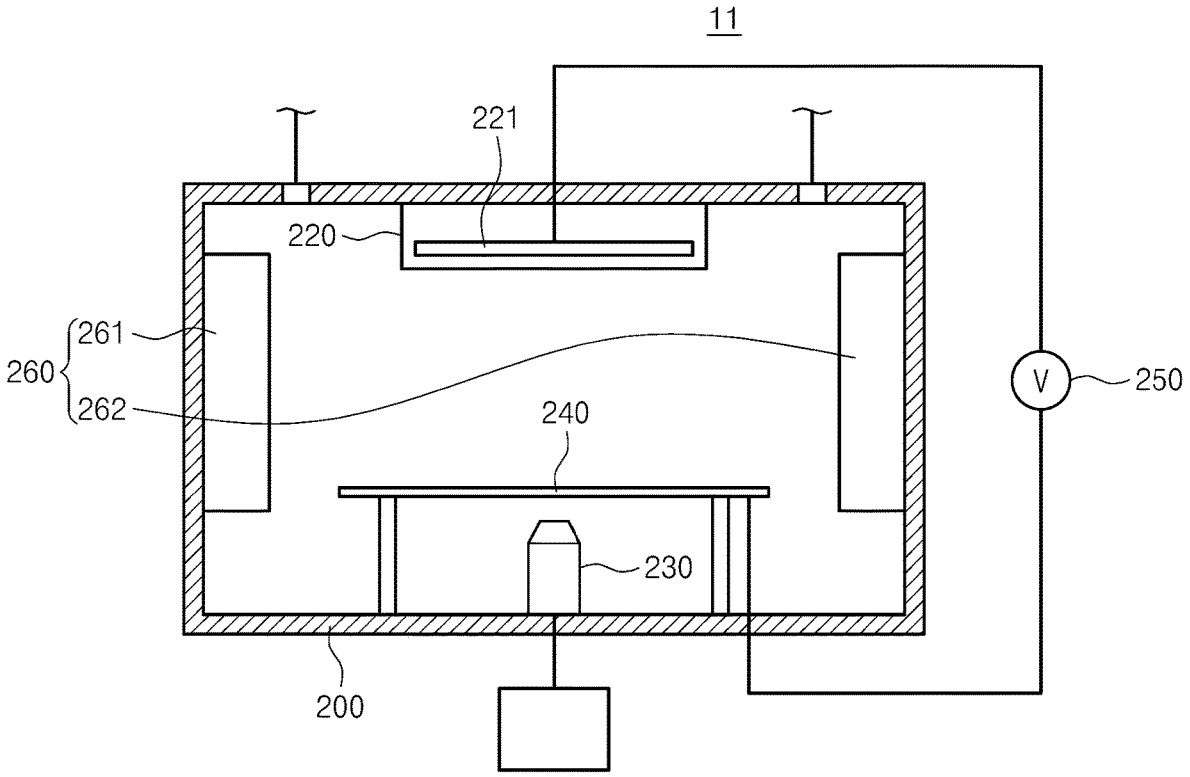
FIG. 6 is a view illustrating a coating apparatus according to another embodiment of the inventive concept.

FIG. 6 is a view illustrating a coating apparatus according to another embodiment of the inventive concept.

Referring to FIG. 6, the coating apparatus 11 includes a chamber 200, a support 220, an ejection nozzle 230, an electric field forming unit 240 and 250, and a magnetic field forming unit 260.

The electric field forming unit 221, 240, and 250 includes an electrode member 240, an auxiliary electrode member 221, and a power source 250.

The auxiliary electrode member 221 is provided inside the support 220. The auxiliary electrode member 221 may be located adjacent to the surface on which the substrate m is located. The auxiliary electrode member 221 may be connected to the power source 250 in a manner that is similar to that of the coating apparatus 10 of FIG. 1. Accordingly, an electric field may be formed between the substrate m and the electrode member 240 by an electric potential between the electrode member 240 and the auxiliary electrode member 221. Further, plasma may be excited between the substrate m and the electrode member 240 by an electric potential between the electrode member 240 and the auxiliary electrode member 221.

Because the configurations and operations of the magnetic field forming unit 260 including the chamber 200, the support 220, the ejection nozzle 230, the electrode member 240, the power source 250, and the first and second magnets 261 and 262, except for the auxiliary electrode member 221, are the same as or similar to those of the coating apparatus 10 of FIG. 1, a repeated description thereof will be omitted.

Figure 7:
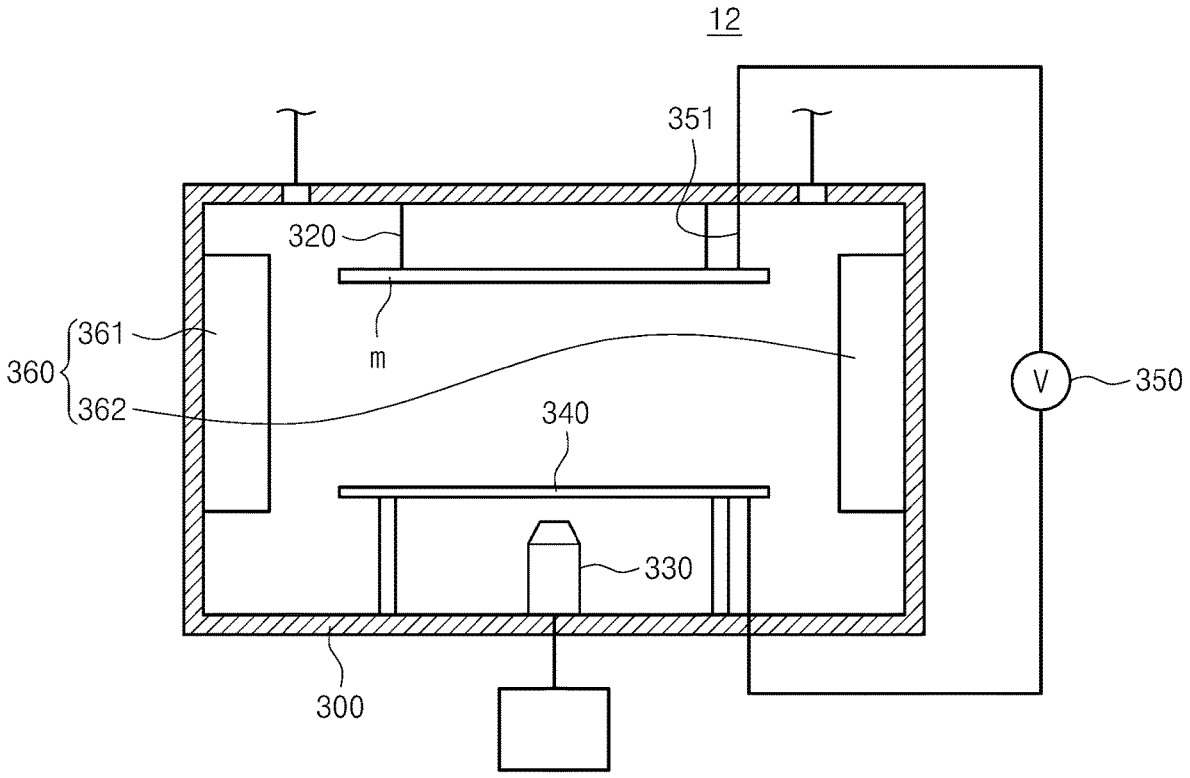
FIG. 7 is a view illustrating a coating apparatus according to another embodiment of the inventive concept.

FIG. 7 is a view illustrating a coating apparatus according to another embodiment of the inventive concept.

Referring to FIG. 7, the coating apparatus 12 includes a chamber 300, a support 320, an ejection nozzle 330, an electric field forming unit 340, 350, and 351, and a magnetic field forming unit 360.

The electric field forming unit 340, 350, and 351 includes an electrode member 340, a connecting rod 351, and a power source 350.

The connecting rod 351 is connected to the power source 350 through an electric wire. The connecting rod 351 may be provided while being fixed to the chamber 300. The connecting rod 351 is provided such that an end of the connecting rod 351 contacts the substrate m if the substrate m is located in the support 320. The connecting rod 351 may be a conductor, or may include an electric wire therein. Accordingly, the substrate m in contact with the connecting rod 351 is electrically connected to the power source 350.

Because the configurations and operations of the magnetic field forming unit 360 including the chamber 300, the support 320, the ejection nozzle 330, the electrode member 340, the power source 350, and the first and second magnets 261 and 262, except for the connecting rod 351, are the same as or similar to those of the coating apparatus 10 of FIG. 1, a repeated description thereof will be omitted.

According to an embodiment of the inventive concept, a coating apparatus and a coating method, by which a substrate may be efficiently coated, may be provided.

The above description exemplifies the inventive concept. Furthermore, the above-mentioned contents describe the exemplary embodiment of the inventive concept, and the inventive concept may be used in various other combinations, changes, and environments. That is, the inventive concept can be modified and corrected without departing from the scope of the inventive concept that is disclosed in the specification, the equivalent scope to the written disclosures, and/or the technical or knowledge range of those skilled in the art. The written embodiment describes the best state for implementing the technical spirit of the inventive concept, and various changes required in the detailed application fields and purposes of the inventive concept can be made. Accordingly, the detailed description of the inventive concept is not intended to restrict the inventive concept in the disclosed embodiment state. Furthermore, it should be construed that the attached claims include other embodiments.

What is claimed is:

1. A coating apparatus comprising:

a chamber;

a support located in an interior space of the chamber and configured to support a substrate which is to be coated;

an ejection nozzle configured to eject a coating material toward a direction of the support;

an electric field forming unit configured to form an electric field along a movement path of the coating material to provide kinetic energy for the coating material, and a magnetic field forming unit configured to form a magnetic field in the movement path of the coating material, wherein electric field lines of the electric field continuously travel in a direction of the movement path of the coating material, wherein the magnetic field forming unit comprises a first magnetic and a second magnet, wherein the substrate is located between upper portions of the first magnet and the second magnet, and wherein the electric field forming unit includes:

an electrode member located between the support and the ejection nozzle; and a power source configured to apply a voltage to the substrate located in the support and the electrode member, and wherein the electrode is located between lower portions of the first magnet and the second magnet.

2. The coating apparatus of claim 1, wherein the electrode member has holes, through which the coating material passes.

3. The coating apparatus of claim 1, wherein the electrode member is provided in a mesh shape.

4. The coating apparatus of claim 1, wherein the substrate is connected to the power source and the electrode member is grounded.

5. The coating apparatus of claim 1, wherein the power source is a DC power source.

6. The coating apparatus of claim 1, wherein the support is located on an upper wall of the chamber and the electrode member is located at a lower portion of the interior space of the chamber.

7. The coating apparatus of claim 1, wherein the chamber has an exhaust hole for exhausting the interior space thereof.

8. The coating apparatus of claim 1, wherein the electric field forming unit further includes:

a connecting line that connects the substrate to the power source to apply a voltage if the substrate is located in the support.

9. The coating apparatus of claim 1, wherein the electric field forming unit further includes:

an auxiliary electrode member located inside the support and electrically connected to the power source.

10. The coating apparatus of claim 1, wherein the ejection nozzle ejects the coating material in an aerosol state.

11. The coating apparatus of claim 1, wherein the magnetic field forming unit is located on a side of the movement path of the coating material.

12. The coating apparatus of claim 1, wherein the first magnet and the second magnet located on opposite sides with respect to the movement path of the coating material.

* * * * *